US010507951B2

(12) United States Patent
Giannasi et al.

(10) Patent No.: US 10,507,951 B2
(45) Date of Patent: Dec. 17, 2019

(54) PACKAGING WITH SPRING LOADED HANGER

(71) Applicant: Otter Products, LLC, Fort Collins, CO (US)

(72) Inventors: Mark A. Giannasi, Fort Collins, CO (US); James V. Eyerman, Fort Collins, CO (US); Timothy J. Lancaster, Fort Collins, CO (US)

(73) Assignee: Otter Products, LLC, Fort Collins, CO (US)

( * ) Notice: Subject to any disclaimer, the term of this patent is extended or adjusted under 35 U.S.C. 154(b) by 282 days.

(21) Appl. No.: 15/676,572

(22) Filed: Aug. 14, 2017

(65) Prior Publication Data

US 2018/0065775 A1 Mar. 8, 2018

Related U.S. Application Data

(60) Provisional application No. 62/383,857, filed on Sep. 6, 2016.

(51) Int. Cl.

| | |
|---|---|
| ***B65D 6/06*** | (2006.01) |
| ***B65D 25/22*** | (2006.01) |
| ***B65D 25/54*** | (2006.01) |
| ***B65D 5/42*** | (2006.01) |
| ***B65D 5/38*** | (2006.01) |

(52) U.S. Cl.

CPC ..... *B65D 11/12* (2013.01); *B65D 5/38* (2013.01); *B65D 5/4208* (2013.01); *B65D 7/10* (2013.01); *B65D 9/08* (2013.01); *B65D 25/22* (2013.01); *B65D 25/54* (2013.01)

(58) Field of Classification Search

CPC ..... B65D 11/12; B65D 25/22; B65D 25/54; B65D 5/38; B65D 5/4208; B65D 5/46192; B65D 7/10; B65D 9/08; B65D 5/46008; B65D 5/46024; B65D 5/46032

USPC .... 206/279, 284, 289, 806; 220/8, 751, 752, 220/754, 755, 759, 768, 770; 229/117.09, 229/117.13, 117.15, 117.19, 117.23, 229/117.24

See application file for complete search history.

(56) References Cited

U.S. PATENT DOCUMENTS

| | | | | |
|---|---|---|---|---|
| 4,347,930 | A | 9/1982 | Herrin | |
| 4,520,978 | A | 6/1985 | Taub | |
| 5,657,873 | A | 8/1997 | Hustad et al. | |
| 5,728,440 | A | 3/1998 | Good | |
| 6,119,874 | A | 9/2000 | Anderson | |
| 6,758,340 | B1 | 7/2004 | Feibelman | |
| 7,128,222 | B2 | 10/2006 | Doucette | |
| 7,798,328 | B2 | 9/2010 | Hession | |
| 7,909,168 | B2 | 3/2011 | Virvo | |
| 8,936,158 | B2 | 1/2015 | Salow et al. | |
| 2006/0042985 | A1 | 3/2006 | Bucovetsky | |
| 2007/0039840 | A1* | 2/2007 | Mu | B65D 5/38 206/278 |

(Continued)

*Primary Examiner* — James N Smalley
*Assistant Examiner* — Madison L Poos

(57) ABSTRACT

A packaging assembly for a product includes a tray for holding the product, a sleeve for slidably receiving the tray, and a hanger insertable into a slot in the sleeve. The hanger includes a spring arm configured to exert a spring force between an inside surface of the sleeve and the tray when the tray is in the sleeve to increase a force required to remove the tray from the sleeve, the hanger also providing a hang point for the packaging assembly.

20 Claims, 6 Drawing Sheets

(56) References Cited

U.S. PATENT DOCUMENTS

| | | | |
|---|---|---|---|
| 2015/0076013 | A1 | 3/2015 | Fath et al. |
| 2016/0198867 | A1 | 7/2016 | Mendelowitz et al. |

* cited by examiner

PACKAGING WITH SPRING LOADED HANGER

CROSS REFERENCE TO RELATED APPLICATION

This application claims priority to U.S. Provisional Patent Application 62/383,857, filed Sep. 6, 2016, the disclosures of which are hereby incorporated by references in their entirety.

BACKGROUND

Many products are sold in packaging which can be repeatedly opened and/or closed while not damaging the packaging and without requiring significant effort or other supplies to re-close the package. In many retail environments, it is desirable to have packages which easily open to allow customers to see the product, touch the product, inspect the product, and/or temporarily remove the product from the package before making a purchase decision. At the same time, it is also desirable to be able to easily return the product to the package and easily return the package and product to its original state for potential viewing, handling, and/or purchase by other customers. It is also often desirable to hang product and/or packages on pegs or posts for good visibility and/or easy access by customers and/or store employees. An improved product package is disclosed herein.

SUMMARY

In one example, a packaging assembly for a product includes a tray, a sleeve, and a hanger. The tray is for holding, storing, containing, and/or displaying the product. The sleeve slidably receives the tray such that the product is contained inside the sleeve and the tray when the tray is in the sleeve. The hanger is insertable into a slot of the sleeve such that the hanger exerts a spring force between an inside surface of the sleeve and the tray when the tray is in the sleeve. The spring force increases a force required to remove the tray from the sleeve. The hanger also provides a hang point for the packaging assembly.

In another example, a packaging assembly for a product includes a tray comprising a plurality of sides bounding a cavity for receiving the product; a sleeve comprising a front wall, a back wall attached to the front wall by a plurality of side walls, a slot extending through one of the plurality of sidewalls, and an opening for slidably receiving the tray; and a spring loaded hanger configured to be inserted in the slot in the sleeve. The spring loaded hanger includes a hang point for the packaging assembly; a lip having a dimension greater than a width of the slot, the lip contacting an inner surface of a wall of the sleeve to prevent the hanger from passing completely through the slot; and a plurality of spring arms, each spring arm configured to compress between an inside wall surface of a side wall of the sleeve and a side wall of the tray, the compression deforming the spring arms and providing a spring force to provide friction or static friction between the tray and sleeve to resist the removal of the tray from the sleeve.

In still another example, a spring loaded hanger for a packaging assembly includes a lip having a dimension greater than a width of the slot, the lip contacting an inner surface of a wall of the sleeve to prevent the hanger from passing completely through the slot; and a plurality of spring arms, each spring arm configured to compress between an inside wall surface of a side wall of the sleeve and a side wall of the tray, the compression deforming the spring arms and providing a spring force to provide friction or static friction between the tray and sleeve to resist the removal of the tray from the sleeve.

DETAILED DESCRIPTION

Products are often displayed or presented to customers in packaging that allows customers and/or store employees to easily remove the product from the packaging. The product may be removed to see the product, feel the product, inspect the product, and/or check whether the product is compatible with another item. It is desirable to be able to easily and quickly return the product to the packaging and returning the packaging to its original state such that it is available for other customers and appears unused and/or unopened. It is also desirable to have packages or packaging which can hang on pegs or posts in order to make the product(s) visible to customers or store employees and/or to make them easy to find by customers or store employees.

In one example, an accessory for an electronic device, such as a case for a smartphone, may be sold in packaging. It may be desirable to easily remove the accessory from the packaging in a retail environment while still making it easy to return the product to the packaging and its original state for potential inspection or purchase by another customer. It may be desirable to remove the accessory to check compatibility with the electronic device, inspect its color or texture, or otherwise evaluate the accessory. Many other examples of products and packaging configurations are possible and the techniques introduced herein are not to be limited to any particular type of product, packaging, product, or use.

While making packaging easy to open and close and easy to repeatedly open and close is desirable, packaging which comes open too easily can also be problematic, particularly during shipping. Packaging may inadvertently open, full or partially, during shipping. Packaging which relies on friction fits can be convenient, but can be susceptible to these issues. Despite the convenience, packaging which relies on friction fits often has tighter manufacturing tolerances to achieve the right level of friction and, therefore, ends up being more expensive and/or difficult to produce. A packaging assembly is disclosed herein which is easy to repeatedly open and close while also reducing the tolerance requirements and providing a hang tag or hang point.

Figure 1:
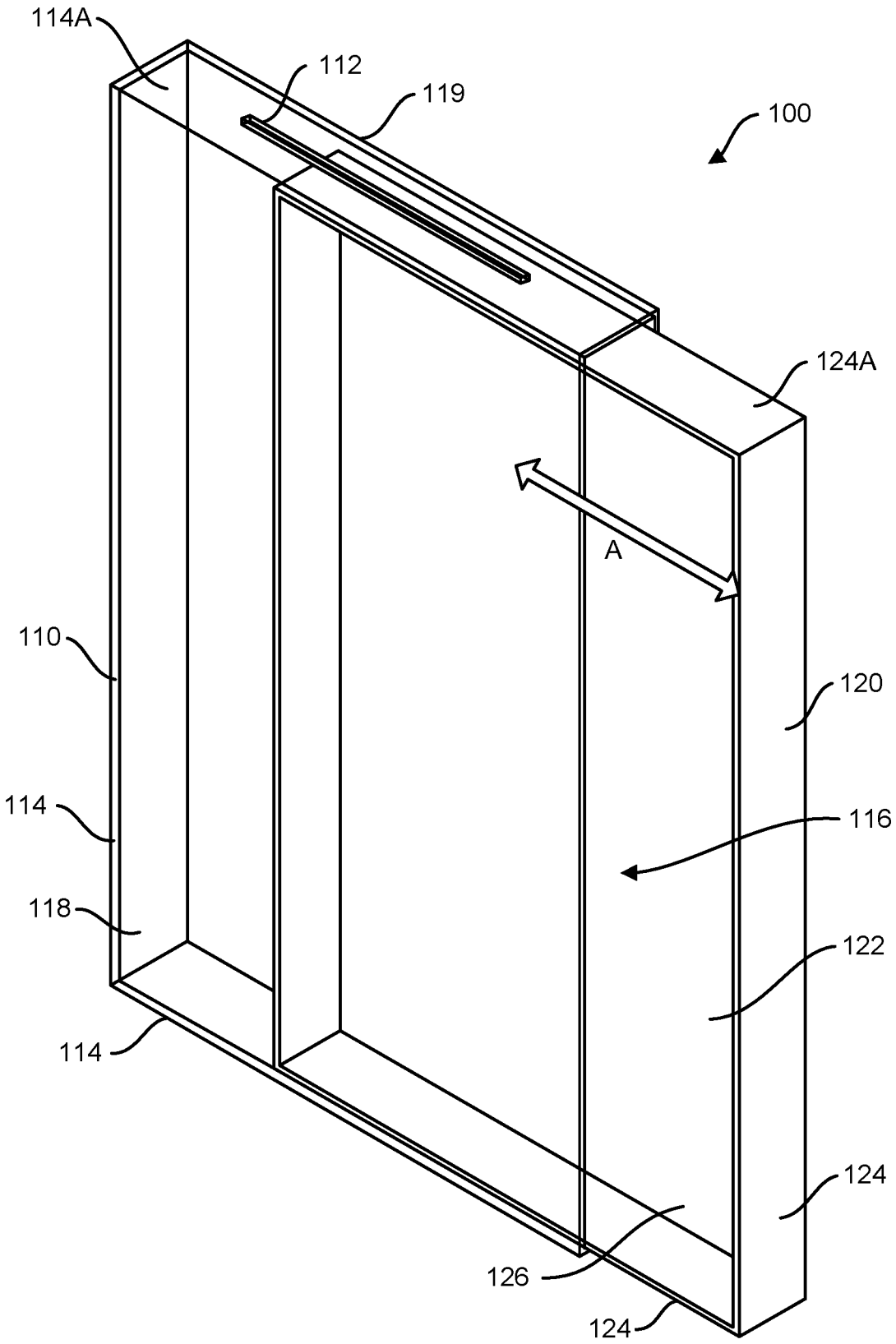
FIG. 1 illustrates packaging for a product.

FIG. 1 illustrates packaging 100 for a product. Packaging 100 includes sleeve 110 and tray 120. Sleeve 110 and/or tray 120 may be made of any suitable product including cardboard, corrugated cardboard, fiberboard, compressed paper, compressed fiber, processed pulp, recycled materials, plastic, polyethylene terephthalate (PET), high-density polyethelene (HDPE), polyvinyl chloride (PVC), low-density polyethelene (LDPE), polypropylene (PP), polystyrene (PS), metal, wood, and/or any other suitable packaging material, including combinations thereof.

Tray 120 has a cavity or open area 122 for containing a product or a plurality of products. Cavity 122 is illustratively bounded by side walls 124 and back wall 126 of tray 120. In other exemplary embodiments, tray 120 may include only side walls 124, or tray 120 may include side walls 124, back wall 126, and a front wall (not shown) opposite back wall 126.

Sleeve 110 may also be described as an envelope or sheath and contains tray 120 when tray 120 is inserted into sleeve 110. When tray 120 is in sleeve 110, cavity 122 is enclosed such that the product(s) are contained inside package 100 when it is closed. Tray 120 may include other features for holding the product(s) in place, such as a tray or insert, inside packaging 100.

Sleeve 110 illustratively includes a plurality of side walls 114, a front wall 118, and a back wall 119. Sleeve 110 further includes an opening 116 into which tray 120 can be received. Although illustrated as an opening 116 along a left side wall of sleeve 110, in other embodiments, sleeve 110 may include a first opening 116 along a first side wall of sleeve 110, and a second opening (not shown) along a second side wall of sleeve 110 opposite the first opening 116. Moreover, although opening 116 is illustrated as defining the entirety of the right side wall of sleeve 110, in other embodiments (not shown) opening 116 may define only a portion of the side wall of sleeve 114, or the opening may extend at least partially into the top and/or bottom side wall 114 of sleeve 110.

Sleeve 110 also includes a slot or opening 112 along one side wall 114A in which a spring loaded hanger (see FIG. 3) may be inserted. Wall 124A of tray 120 is positioned proximate side wall 114A of sleeve 110 when tray 120 is inserted into sleeve 110.

Sleeve 110 may also be transparent or contain transparent portions so at least a portion of the product(s) are visible while inside the packaging. As illustrated in FIG. 1, at least a portion of the front side wall 118 and side wall 114 may include a transparent portion. However, it may still be desirable to easily open and close packaging 100 to access the product(s), particularly in a retail environment. This can be accomplished by sliding tray 120 out of sleeve 110 (as indicated by the arrow A), partially or fully. The slide fit between tray 120 and sleeve 110 must be sufficiently loose to allow tray 120 to be easily slid in and out of sleeve 110. At the same time, it cannot be too loose or tray 120 may inadvertently come out of sleeve 110, such as during shipping or handling. While sufficiently maintaining the tolerances necessary to achieve the right level of friction may be possible, tighter or smaller tolerances typically increase costs, reduce manufacturing throughput, increase tool complexity, and/or increase waste. Therefore, it is desirable to have packaging which has a desirable amount of slide friction between tray 120 and sleeve 110 while also having relaxed tolerances for the components, and without increasing cost, and/or increasing these other undesirable characteristics of tighter manufacturing tolerances.

Figure 2A:
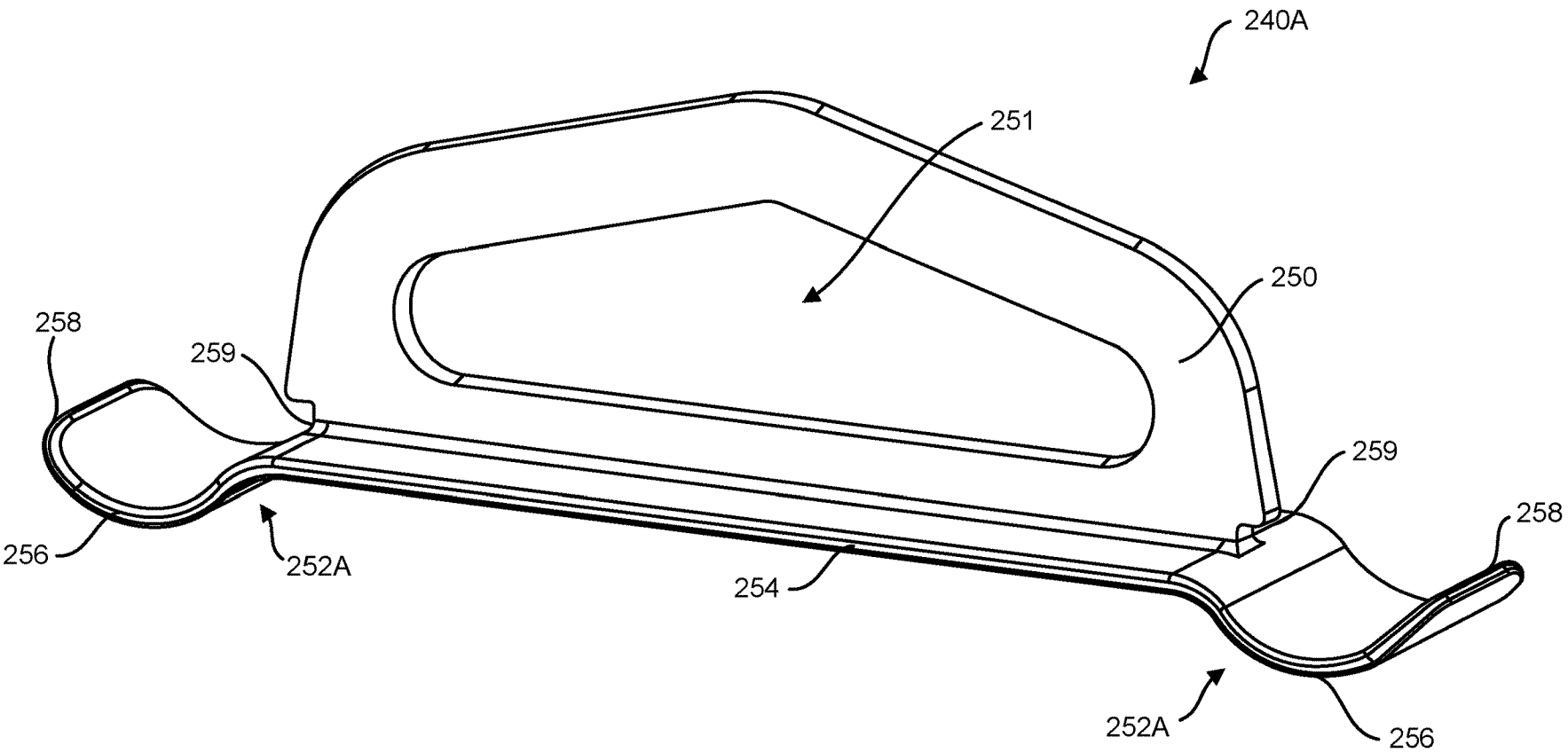
FIG. 2A illustrates an exemplary embodiment of a spring loaded hanger.
Figure 2B:
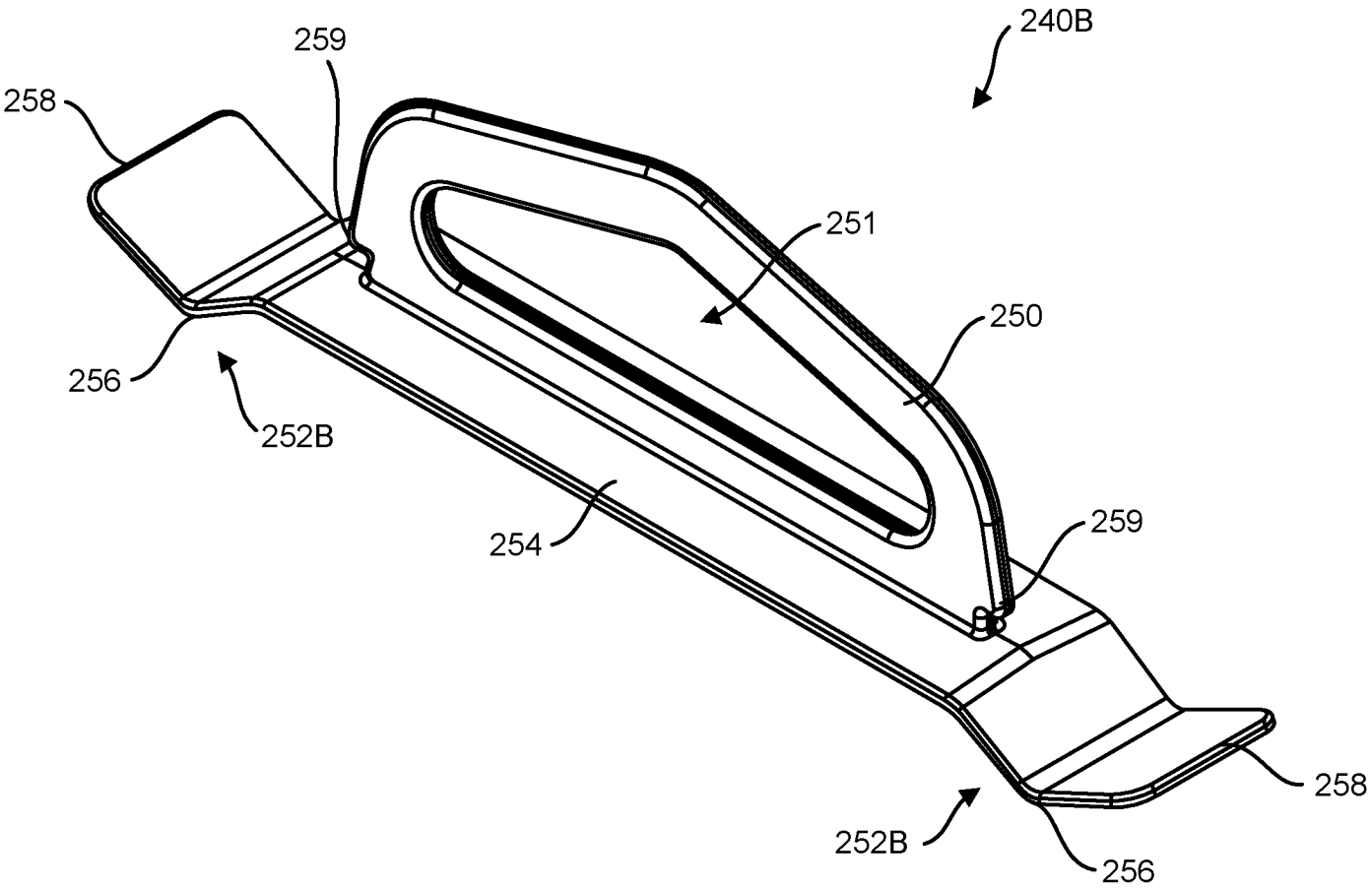
FIG. 2B illustrates another exemplary embodiment of a spring loaded hanger.
Figure 2C:
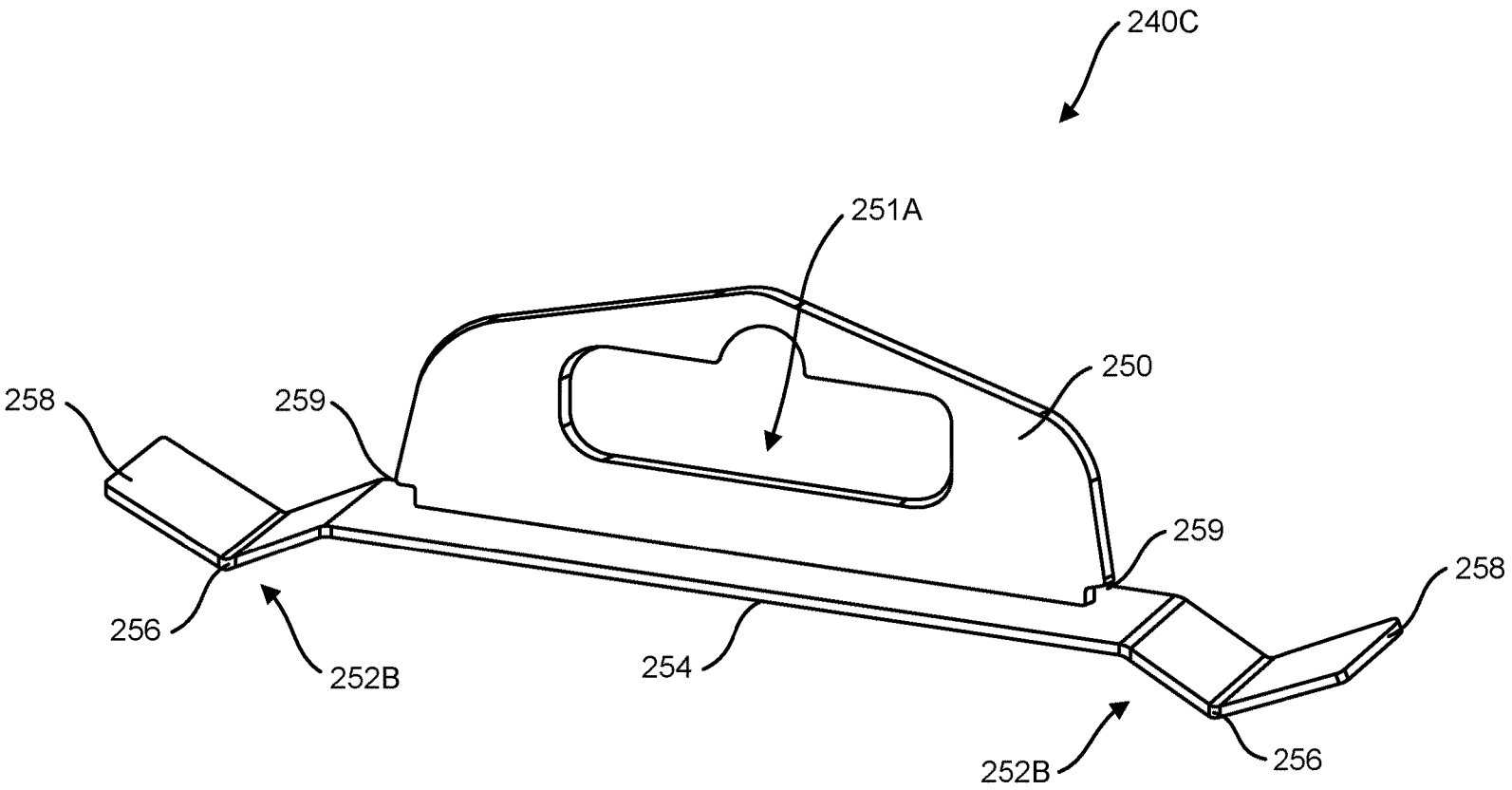
FIG. 2C illustrates still another exemplary embodiment of a spring loaded hanger.

FIGS. 2A-2C illustrate several exemplary spring loaded hangers 240A, 240B, and 240C for use with packaging 100. Spring loaded hangers 240A, 240B, and 240C include several similar components, and similar numbering will be used to refer to similar parts between each spring loaded hanger 240. Each spring loaded hanger 240A, 240B, and 240C may be made of any material, or combination of materials, that is flexible and has sufficient springing characteristics, such as plastic or metal.

Figure 3:
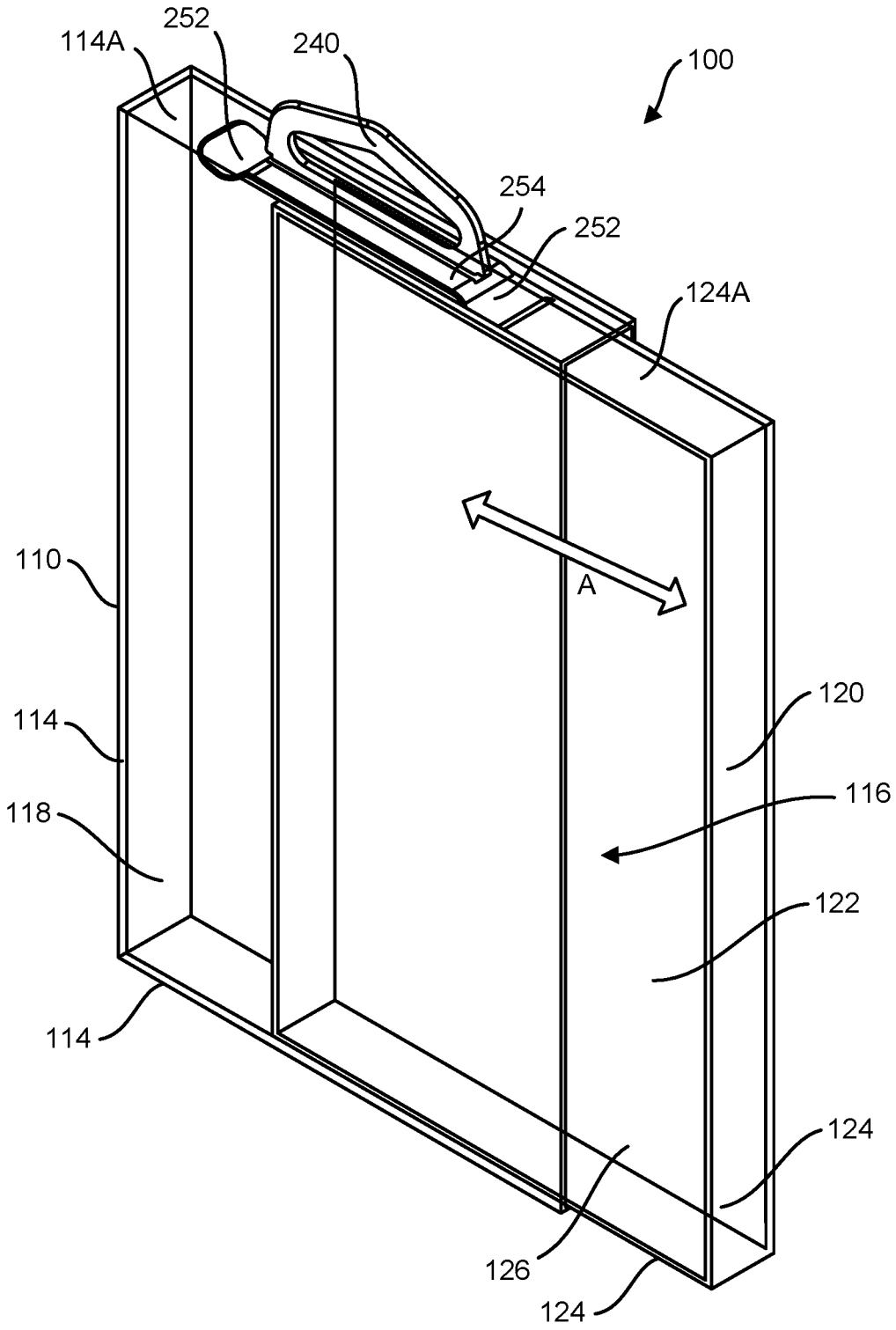
FIG. 3 illustrates a packaging assembly with a spring loaded hanger installed.

As illustrated in FIG. 3, spring loaded hanger 240 is inserted through slot 112 of sleeve 110, but does not go all the way through slot 112 as it is stopped by lip 254. Lip 254 may be any type of lip, ledge, shelf, tab, post, and/or arm that prevents spring loaded hanger 240 from sliding all the way through slot 112. As illustrated in FIG. 3, lip 254 is wider than slot 112 and contacts an inner surface of wall 114A on a front and back side of slot 112, preventing spring loaded hanger 240 from passing through slot 112.

Referring next to FIGS. 2A-2C, each spring loaded hanger 240A, 240B, 240C also includes a hang point 250 extending from lip 254 for hanging on a peg, post, arm, or other storage or display mechanism. Hang point 250 illustratively includes an aperture 251 through which a peg, post, arm, or similar display mechanism may be placed to support packaging 100 in a hanging display configuration. As illustrated, aperture 251 may be generally triangular shaped, although other suitable shapes may also be used. Spring loaded hanger 240 may have other shapes and/or configurations. Hang point 250 may include other features for hanging or attaching packaging 100.

Each spring loaded hanger 240 also includes one or more spring arms 252 configured flex when force is applied. Each spring arm 252 includes a tray contact portion 256 and a sleeve contact portion 258. In the exemplary embodiments illustrated in FIGS. 2A-2C, each spring arm 252 extends downward from lip 254 to tray contact portion 256. Each spring arm 252 further extends upward from the tray contact portion 256 to the sleeve contact portion 258.

As illustrated in FIG. 3, when spring loaded hanger 240 is inserted into sleeve 110 and tray 120 is inserted into sleeve 110, spring arms 252 are compressed between an inside wall surface of wall 114A of sleeve 110 and corresponding side wall 124A of tray 120. In particular, the tray contact portion 256 contacts the side wall 124A of tray 120 and the sleeve contact portion 258 contacts the inside wall surface of wall 114A of sleeve 110. This compression results in a deformation of spring arms 252 and a spring force being applied between wall 124 and sleeve 110 by spring arms 252 which increases the friction, or static friction, between them and holds tray 120 in place inside sleeve 110. This reduces the likelihood of tray 120 inadvertently sliding out of sleeve 110 during shipping or handing without requiring the more precise dimensional tolerances between tray 120 and sleeve 110 which would be necessary without the use of spring loaded hanger 240 and/or spring arms 252. When the tray 120 is removed, the spring arms 252 are no longer compressed and each spring arm 252 can return to its original configuration.

Figure 4:
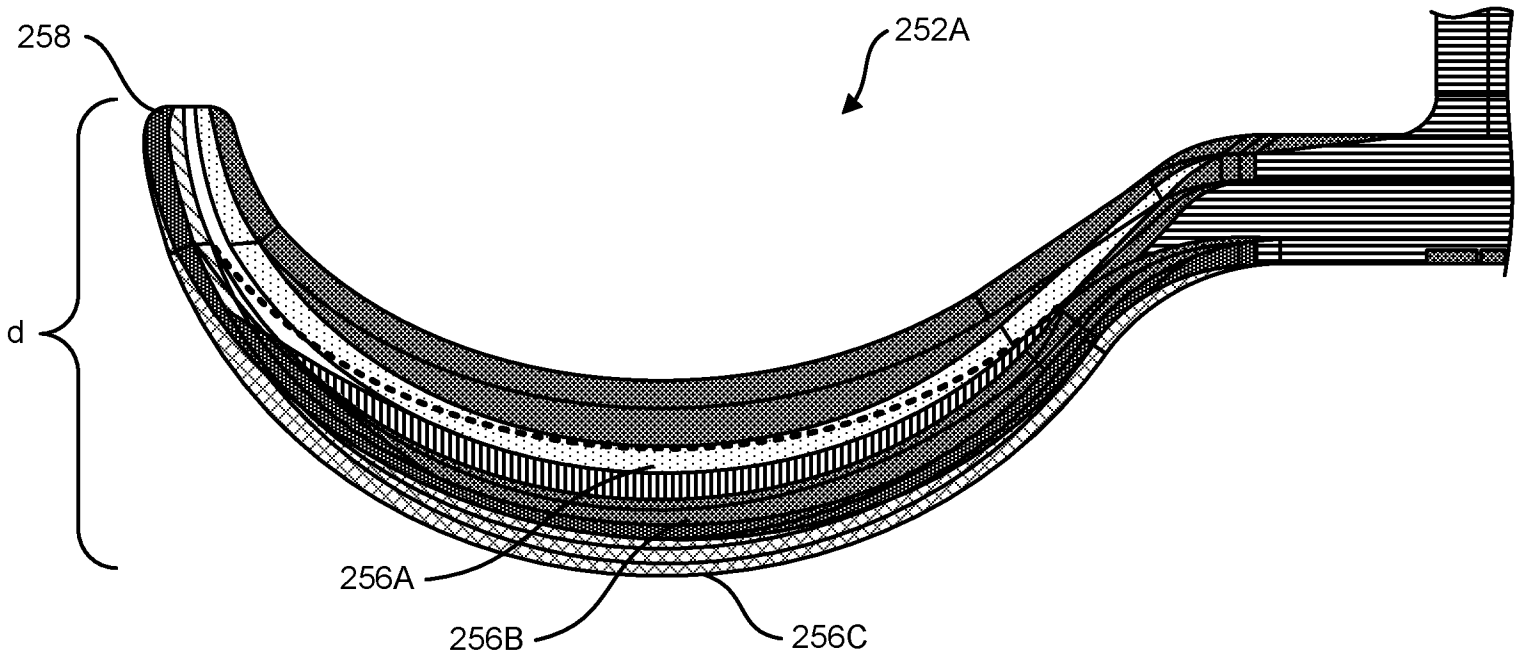
FIG. 4 illustrates a close up view of a spring arm of several spring loaded hangers of FIG. 2A having different dimensions.

Referring to FIG. 2A, a first spring loaded hanger 240A is illustrated that includes curved spring arms 252A configured to flex when force is applied to each spring arm 252A. The curvature of spring arm 252A provides the benefit of the spring force and deflection discussed herein, but also provides a smooth and/or gradual surface to meet an edge 124A of tray 120 when tray 120 is inserted to reduce the possibility of catching or snagging. FIG. 4 illustrates a close up view of spring arm 252A of several overlapping spring loaded hanger 240A. The curvature of each spring arm 252A is different to provide a different horizontal distance d between the different tray contact portion 256A, 256B, and 256C and a common sleeve contact portion 258. The different distances d illustrated in FIG. 4 providing for different spring forces for each spring arm 252A.

Referring to FIG. 2B, a second spring loaded hanger 240B is illustrated that includes angled spring arms 252B configured to flex when force is applied to each spring arm 252B. Spring arm 252B extends in a generally straight line downward from lip 254 to tray contact portion 256, where it changes direction and extends in a generally straight line upward to the sleeve contact portion 258. The upward slope of spring arm 252B provides a generally flat surface to contact side 124A of tray 120 when tray 120 is inserted to reduce the possibility of catching or snagging.

Referring to FIG. 2C, a third spring loaded hanger 240C is illustrated. Spring loaded hanger 240C is similar to spring loaded hanger 240C but includes a differently shaped aperture 251A.

Referring again to FIG. 3, the compression or deflection of spring arms 252 between tray 120 and sleeve 110 allow the fit requirements between tray 120 and sleeve 110 to be relaxed or reduced while still providing a sufficient friction fit between them such that the packaging can be easily opened, but not so loose as to increase likelihood of inadvertent opening due to shipping, handling, and/or vibration. In other words, spring arms 252 create friction to more reliably keep tray 120 in sleeve 110 even though the dimensions of tray 120 may be reduced and/or the tolerances associated with tray 120 and/or sleeve 110 may be relaxed. The extra space associated with the dimensional reductions and/or tolerance relaxation is accommodated by the springing and/or flexing characteristics of the spring arms which accommodate any additional space and/or variations.

It should be understood that more or fewer spring arms are possible. It should also be understood that other spring arm shapes are possible. It should further be understood that many spring arms shapes, curvatures, thickness, cross sections, and/or materials may be possible to achieve varying levels of travel, deflection, and/or spring force. Varying the levels of travel, deflection, and/or spring force may be desirable depending on the type of packaging, the size of the packaging, the type or weight of product(s) inside the packaging, shipping environments or conditions, and/or a desired range of opening force.

Spring loaded hanger 240 may also include one or more retention features 259. Retention features 259 may include one or more of a tab, lip, recess, slot, protrusion, and/or notch which catches on an edge of slot 112 of sleeve 110 such that spring loaded hanger 240 does not readily fall out of or come out of slot 112 when tray 120 is removed from sleeve 110. In other words, the dimensions of spring loaded hanger 240 relative to those of slot 112 may be such that spring loaded hanger can relatively easily be pushed through slot 112 during installation but tight enough such that it catches in notches, such as retention features 259, and does not come out easily due to gravity. In this way spring loaded hanger 240 will remain in place in sleeve 110 even if tray 120 is removed, permanently and/or temporarily.

In some situations, different spring loaded hangers and/or spring loaded hangers with different spring arms may be selected based on the type of packaging and/or the type or weight of the product being placed in the packaging. In other situations, different spring loaded hangers and/or spring loaded hangers with different spring arms may be selected based on the type of retail environment, the type of shipping, and/or the expected shipping distance. It should also be understood that the springing features and deflection characteristics of the spring arms described herein may be implemented and utilized without necessarily including the hanging feature or the function of hang point 250.

The elements, components, and steps described herein are meant to exemplify some types of possibilities. In no way should the aforementioned examples limit the scope of the invention, as they are only exemplary embodiments.

The phrases "in some embodiments," "according to some embodiments," "in the embodiments shown," "in other embodiments," "in some examples," "in other examples," "in some cases," "in some situations," "in one configuration," "in another configuration," and the like generally mean that the particular technique, feature, structure, or characteristic following the phrase is included in at least one embodiment of the present invention and/or may be included in more than one embodiment of the present invention. In addition, such phrases do not necessarily refer to the same embodiments or to different embodiments.

The foregoing disclosure has been presented for purposes of illustration and description. Other modifications and variations of the disclosed techniques may be possible in view of the above teachings. The embodiments described in the foregoing disclosure were chosen to explain the principles of the concept and its practical application to enable others skilled in the art to best utilize the invention. It is intended that the claims be construed to include other alternative embodiments of the invention, except as limited by the prior art.

What is claimed is:

1. A packaging assembly for a product, the packaging assembly comprising:

a tray for holding the product;

a sleeve for slidably receiving the tray, wherein the product is contained inside the sleeve and the tray when the tray is in the sleeve, the sleeve having a slot; and a hanger insertable into the slot of the sleeve, wherein the hanger includes at least one spring arm configured to exert a spring force between an inside surface of the sleeve and the tray when the tray is in the sleeve to increase a force required to remove the tray from the sleeve, the hanger also providing a hang point for the packaging assembly.

2. The packaging assembly of claim 1, wherein the hanger includes a plurality of spring arms exerting the spring force on the tray.

3. The packaging assembly of claim 2, wherein the plurality of spring arms are configured to compress between an inside wall surface of a side wall of the sleeve and a side wall of the tray, the compression deforming the spring arms and providing the spring force to increase a friction or static friction force between the tray and sleeve.

4. The packaging assembly of claim 2, wherein each spring arm includes a tray contact portion for contacting a portion of the received tray and a sleeve contact portion for contacting a portion of the sleeve.

5. The packaging assembly of claim 4, wherein the tray contact portion contacts a side wall of the tray and the sleeve contact portion contacts an inner wall surface of a side wall of the sleeve.

6. The packaging assembly of claim 4, wherein each spring arm has a generally curved shape.

7. The packaging assembly of claim 4, wherein each spring arm has a generally angled shape.

8. The packaging assembly of claim 1, wherein the hanger includes a lip having a dimension greater than a width of the slot, the lip contacting an inner surface of a wall of the sleeve to prevent the hanger from passing through the slot.

9. The packaging assembly of claim 1, wherein the tray includes a cavity for containing the product, the cavity bounded by a back wall and a plurality of side walls.

10. The packaging assembly of claim 1, wherein the sleeve includes a front wall, a back wall, a plurality of side walls, and an opening into which the tray is received.

11. The packaging assembly of claim 1, wherein at least a portion of the sleeve includes a transparent portion.

12. The packaging assembly of claim 1, wherein the hanger further includes a retention feature configured to catch on an edge of the slot of the sleeve such that the hanger does not readily fall out of the slot when the tray is removed from the sleeve.

13. The packaging assembly of claim 12, wherein the retention feature is selected from one or more of a tab, a lip, a recess, a slot, a protrusion, and a notch.

14. A packaging assembly for a product, the packaging assembly comprising:

a tray comprising a plurality of sides bounding a cavity for receiving the product;

a sleeve comprising a front wall, a back wall attached to the front wall by a plurality of side walls, a slot extending through one of the plurality of side walls, and an opening for slidably receiving the tray; and a spring loaded hanger configured to be inserted in the slot in the sleeve, the spring loaded hanger comprising:

a hang point for the packaging assembly;

a lip having a dimension greater than a width of the slot, the lip contacting an inner surface of a wall of the sleeve to prevent the hanger from passing completely through the slot; and a plurality of spring arms, each spring arm configured to compress between an inside wall surface of one of the plurality of side walls of the sleeve and a side of the tray, the compression deforming the spring arms and providing a spring force to provide friction or static friction between the tray and sleeve to resist the removal of the tray from the sleeve.

15. The packaging assembly of claim 14, wherein each spring arm includes a tray contact portion for contacting a portion of the received tray and a sleeve contact portion for contacting a portion of the sleeve.

16. The packaging assembly of claim 15, wherein each spring arm has a substantially curved shape extending from the lip down to the tray contact portion and up to the sleeve contact portion.

17. The packaging assembly of claim 15, wherein each spring arm has a substantially angled shape including a first substantially straight portion extending from the lip down to the tray contact portion and a second substantially straight portion extending from the tray contact portion up to the sleeve contact portion.

18. A spring loaded hanger configured to be received in a packaging assembly having a sleeve slidably receiving a tray, the spring loaded hanger comprising:

a hang point for suspending the packaging assembly when the spring loaded hanger is received in the packaging assembly;

a lip configured to support the sleeve of the packaging assembly when the spring loaded hanger is received in the packaging assembly; and a plurality of spring arms, each spring arm configured to compress between an inside wall surface of a side wall of the sleeve and a side wall of the tray when the spring loaded hanger is received in the packaging assembly, the compression deforming the spring arms and providing a spring force to provide friction or static friction between the tray and sleeve to resist the removal of the tray from the sleeve.

19. The spring loaded hanger of claim 18, wherein each spring arm has a substantially curved shape extending from the lip down to a tray contact portion and up to a sleeve contact portion.

20. The spring loaded hanger of claim 18, wherein each spring arm has a substantially angled shape including a first substantially straight portion extending from the lip down to a tray contact portion and a second substantially straight portion extending from the tray contact portion up to a sleeve contact portion.

* * * * *